United States Patent [19]

Tauzin

[11] Patent Number: 4,693,033

[45] Date of Patent: Sep. 15, 1987

[54] MECHANISM FOR OPENING, CLOSING AND LOCKING TWO LEAVED DOORS FOR CABLE CARS

[75] Inventor: Francis Tauzin, Veyrins, France

[73] Assignees: Sigma Plastique; Pomagalski S.A., both of France

[21] Appl. No.: 847,386

[22] Filed: Apr. 2, 1986

[30] Foreign Application Priority Data

Apr. 3, 1985 [FR] France ..... 85 05055

[51] Int. Cl.[4] ..... E05C 7/06

[52] U.S. Cl. ..... 49/122; 49/40; 49/246

[58] Field of Search ..... 49/122, 116, 357, 40, 49/246, 366, 41

[56] References Cited

U.S. PATENT DOCUMENTS

| | | | |
|---|---|---|---|
| 6,061 | 9/1874 | Castor | 49/40 |
| 1,171,004 | 2/1916 | Stilling | 49/122 |
| 1,874,562 | 8/1932 | Mariotti | 49/122 X |
| 1,934,929 | 11/1933 | Jonsson | 49/40 X |
| 2,960,778 | 11/1960 | Cowlin | 49/41 X |

FOREIGN PATENT DOCUMENTS

| | | | |
|---|---|---|---|
| 300295 | 9/1932 | Italy | 49/40 |

*Primary Examiner*—Philip C. Kannan
*Attorney, Agent, or Firm*—William A. Drucker

[57] ABSTRACT

A mechanism for opening, closing and locking doors with two leaves for cable cars, wherein the two leaves of a car door are controlled at the top and the bottom by a crank lever integral with a control piece movable horizontally in the vertical plane of symmetry of the two door leaves. Each crank lever acts on a horizontal toggle joint with dead point clearance whose links are pivotally secured respectively to levers rotating about fixed vertical axes forming the axes of rotation of the two door leaves, said levers being connected respectively to the radial arms of the door leaves by resilient connections providing locked closure of the leaves even if one of them is held slightly open.

6 Claims, 8 Drawing Figures

MECHANISM FOR OPENING, CLOSING AND LOCKING TWO LEAVED DOORS FOR CABLE CARS

BACKGROUND OF THE INVENTION

Cable car passenger transport installations, mechanical ski lifts in particular, are developing in the direction of a high increase in the number of passengers within a given time, that is to say a high increase in the transport rate of the transport installations.

In the installations which use cars, the increase in the transport rates requires vehicles which must allow the greatest number of passengers possible to be loaded and unloaded rapidly in as reduced a car volume as possible compatible with the possibilities of the installation comprising the vehicles, which leads to using cabins with large sized accesses, in particular through a door comprising two leaves which may open along the bodywork, either inside or outside this bodywork, each car being moreover possibly equipped with two opposite doors, each with two leaves.

SUMMARY OF THE INVENTION

The essential aim of the invention is to provide an opening, closing and locking mechanism ensuring the irreversibility of the locking while tolerating a certain small gap between the leaves under the effect of an obstacle jammed between these leaves without for all that compromising the locking provided by the irreversibility of the control in the closed position which is opposed to opening under the action of any parasite force exerted on the leaves.

For obtaining the above mentioned reliable locking, the mechanism for actuating a door comprising two leaves symmetrical with respect to a vertical plane passing through the junction line of the two leaves in the closed position is essentially formed of a mobile control piece with horizontal rectilinear movement parallel to the plane of symmetry of the two leaves, this control piece being secured to a crank lever which actuates a horizontal dead point clearance toggle joint formed of two symmetrical links actuating two levers connected to at least two mobile arms fixed respectively to the two leaves by means of a resilient connection which allows limited oscillation of each leaf with respect to its control lever and consequently a gap between the two leaves in the locked and closed position.

The above defined control may be at the top or at the bottom of the door, but two identical controls may also be provided respectively at the top and at the bottom of the door and connected together by a vertical transmission. In addition, in the case of a single resilient connection control, for example at the top of a two leaved door of low height, the single control may act on a vertical transmission means capable of providing locking at the bottom of the door allowing a limited gap.

The movement for opening or closing each leaf may be a pivoting movement through an arc of a circle about a vertical axis about which the lever for actuating the leaf pivots. However, in a variant, each leaf may be secured to two arms of different lengths pivoting in a horizontal plane about different vertical axes whereas the lever controlling this leaf is then connected by the resilient connection to one of these arms.

It will be noted that the invention may be applied, by doubling its actuating mechanisms, to two opposite doors, each with two leaves. The two actuating mechanisms may then be disposed symmetrically with respect to a vertical plane of symmetry between the two doors. Thus, in the same vehicle, two entrance and exit passages are provided through half of the vertical surfaces of the bodywork of the vehicle.

BRIEF DESCRIPTION OF THE DRAWINGS

For a better understanding of the invention, a preferred embodiment and some variants of the invention will be described hereafter by way of example with reference to the accompanying schematical drawings in which.

DESCRIPTION OF THE PREFERRED EMBODIMENTS

Figure 1:
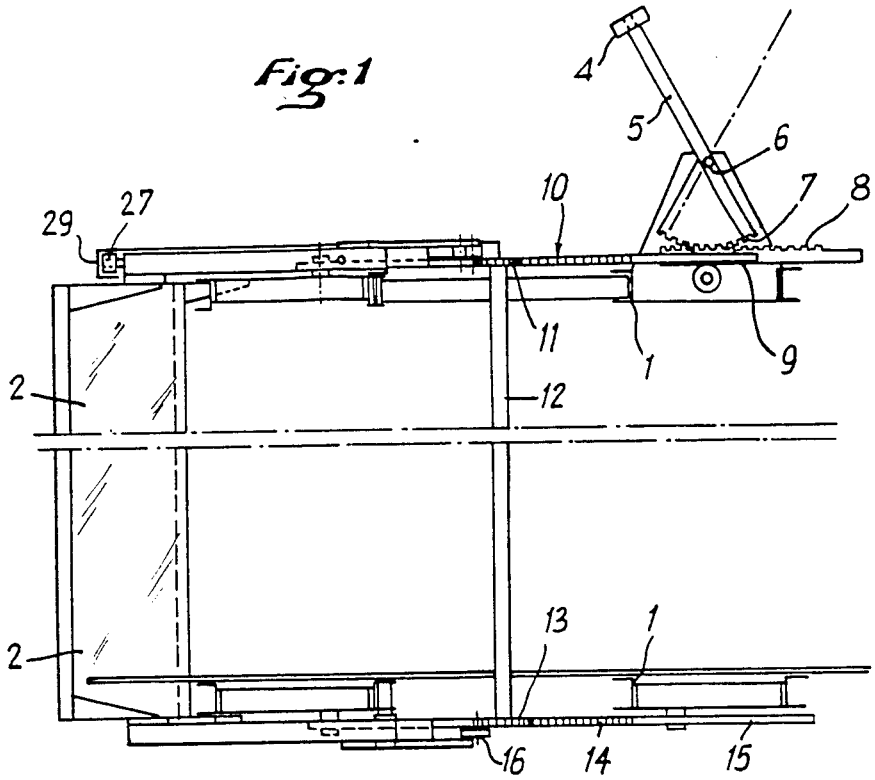
FIG. 1 is a sectional view through a vertical plane between the two leaves of a car door with control handle at the top of the door and actuating mechanisms at the top and bottom of this door shown in the closed position.
Figure 2:
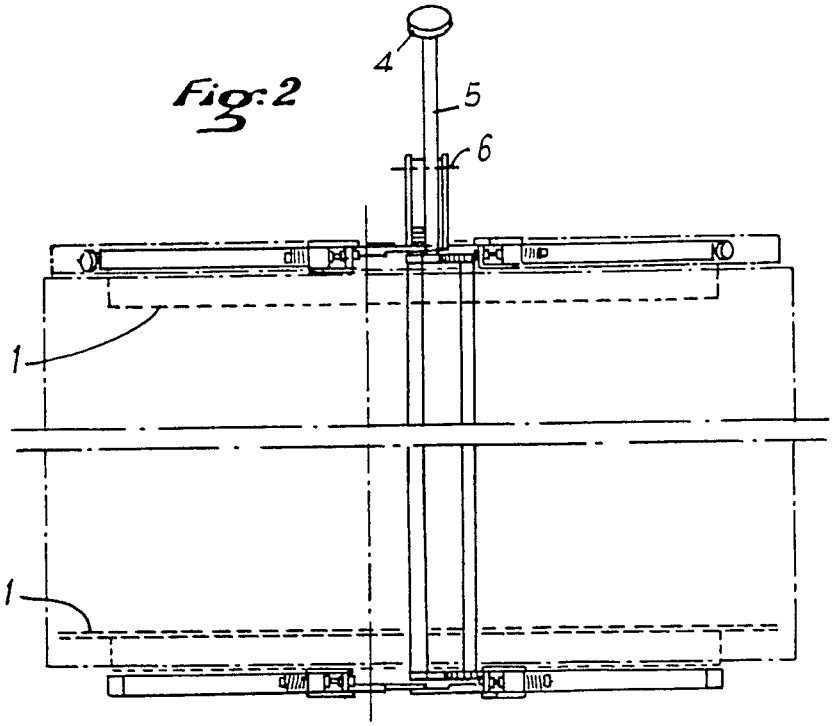
FIG. 2 is a section through a vertical plane perpendicular to the sectional plane of FIG. 1.
Figure 3:
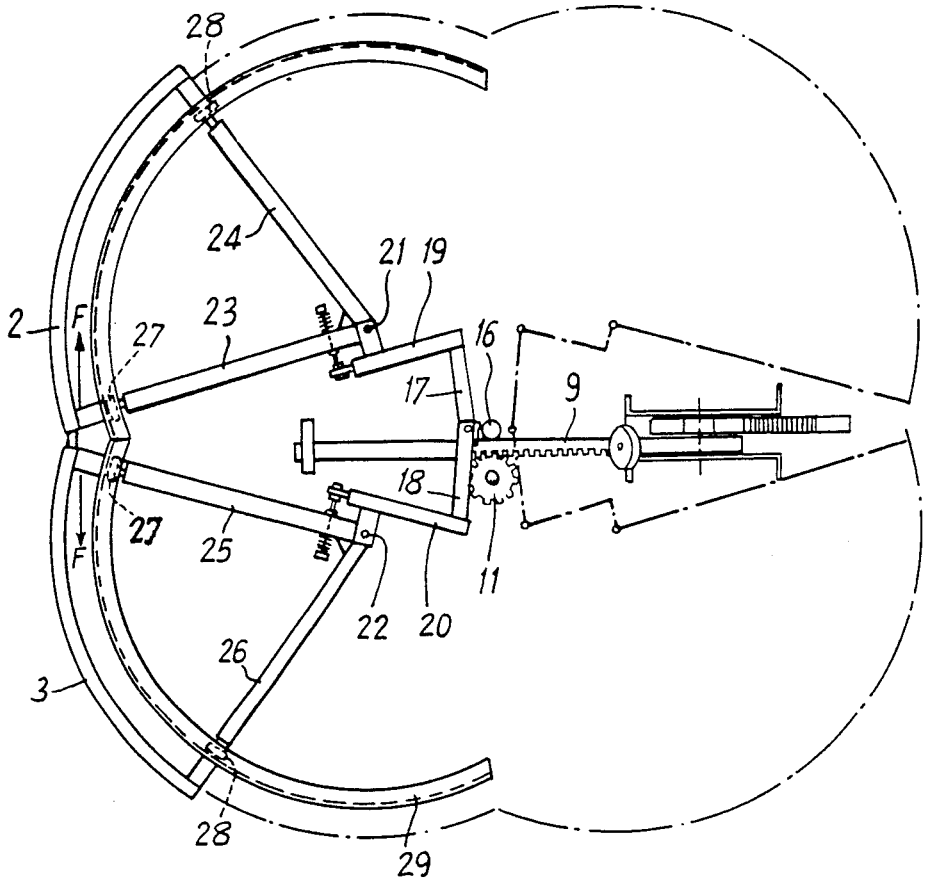
FIG. 3 is a horizontal section in the closed position.
Figure 4:
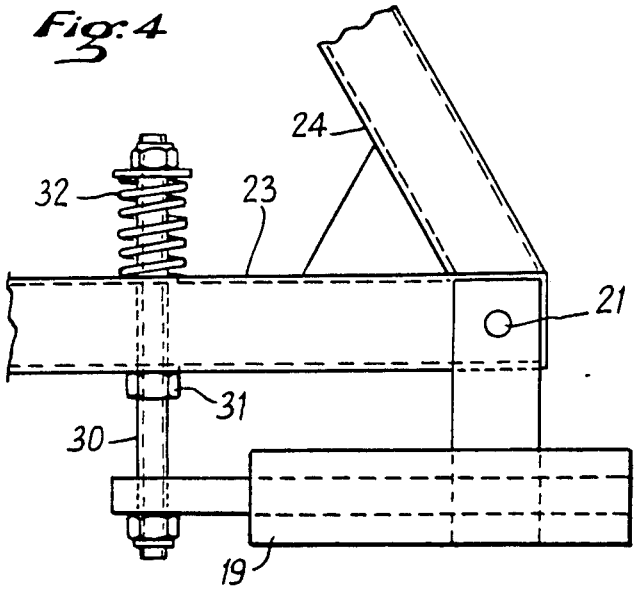
FIG. 4 is an enlarged detail top view showing the resilient connection between an actuating lever and an arm fixed to a leaf of the door.

In the embodiment shown in FIGS. 1 to 4, there is shown at 1 the chassis of the vehicle having a door with two leaves 2–3. A control handle 4 integral with a lever 5 pivoting about the fixed horizontal pin 6 is provided, in the example shown, with a toothed sector 7 meshing with a rack 8 carried by a control piece 9 with rectilinear horizontal movement parallel to the vertical plane of symmetry passing between the two leaves. This control piece comprises another rack 10 with vertical teeth meshing with the teeth of a horizontal pinion 11 carried by the upper end of a vertical transmission shaft 12 which comprises at its base a horizontal pinion 13 identical to pinion 11 and meshing with the rack 14 of a lower control piece 15 identical to the upper control piece 9 and driven with a parallel movement in the same direction.

The two control pieces 9 and 15 drive the two leaves 2–3 respectively at the top and at the bottom by identical means which will only be described hereafter for the control of the leaves at the top. A crank lever 16, integral with the control piece 9, acts on two identical links 17–18 rigidly connected to two symmetrical levers 19–20 rotatable about fixed vertical pins 21–22 fixed to chassis 1 and forming the axes of rotation of the two door leaves 2–3. Lever 19 is connected to the radial arms 23–24 fixed to the leaf 2 by a resilient connection shown on a larger scale in FIG. 4 and lever 20 is similarly connected to the radial arms 25–26 secured to the door leaf 3. Arms 23 to 26 may bear, at their ends opposite the fixed pivoting axes 21–22, through rollers 27–28 on a running tack 29 integral with the chassis and thus supporting the weight of the two door leaves 2–3. The resilient coupling shown in FIG. 4 between a lever 19 and arms 23–24 is formed by a rod 30 secured to lever 19 and passing through a bore in arm 23 with sufficient play to allow a certain oscillation of arm 23 with respect to this rod 30. The oscillation is limited, in the example shown, by a nut 31 and controlled in the opposite direction by the pressure of a spring 32. On the one hand this device allows position of the ends of arms 23 to 26 to be adjusted and also the contact pressure between the two door leaves in the closed position. This resilient device further allows a certain gap between door leaves 2–3 to be tolerated under the effect of an obstacle jammed between the two leaves without for all that adversely affecting the locking explained hereafter. It will be noted that nut 31 could be replaced by a spring allowing oscillation of arms 23 to 26 in both directions in the closed and locked position.

Locking is obtained from the position of links 17–18 which form a toggle joint which, close to the closure position, clear a dead point position corresponding to the alignment of the links so that, in the closed position, the application of parasite forces F exerted on the door leaves in the opening direction are transmitted to the links while tending to jam them more in the locked position. Despite this locking effect, the resilient connections between levers 19–20 and arms 23 to 26 tolerate a certain gap between the dcor leaves.

Figure 5:
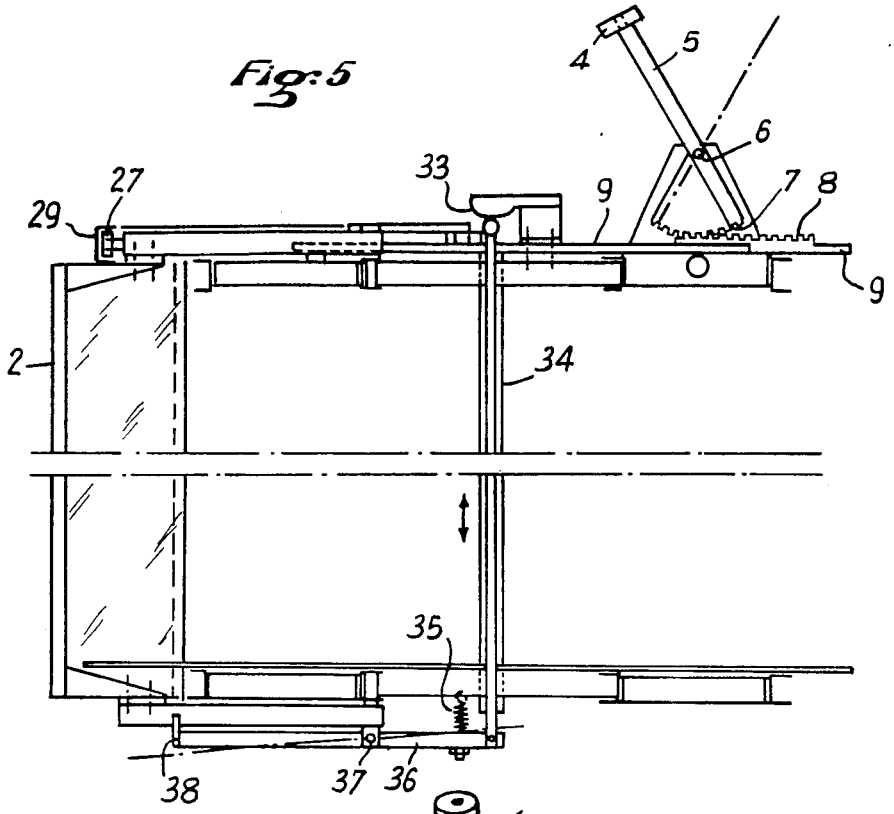
FIG. 5 is a section similar to that of FIG. 1 with a door control provided only at the top of the door but transmitting its movement at the end of closure to a locking means at the bottom of the door through a vertical transmission rod.
Figure 6:
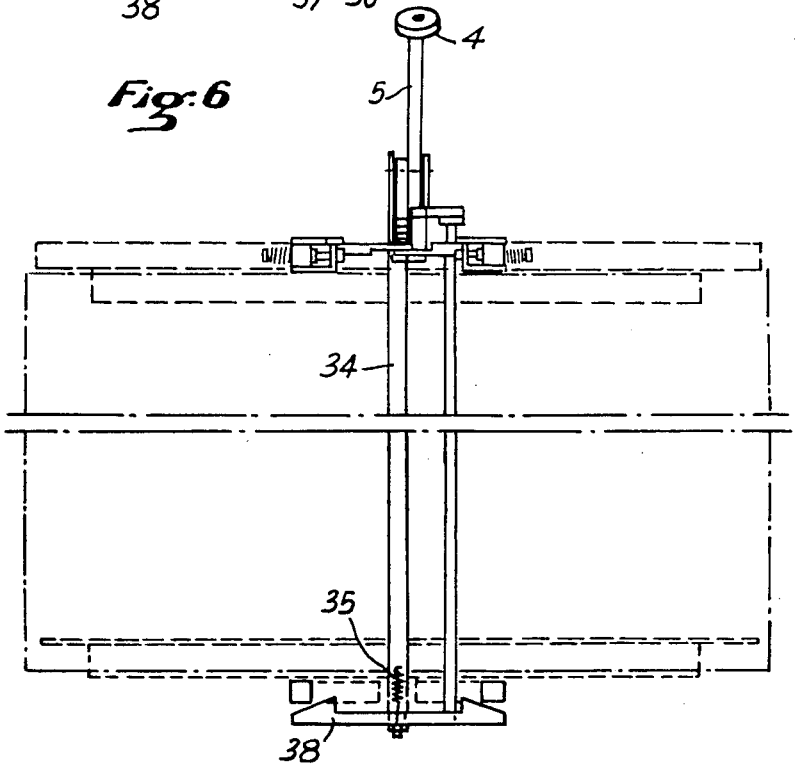
FIG. 6 is a section similar to that of FIG. 2 but corresponding to FIG. 5.
Figure 7:
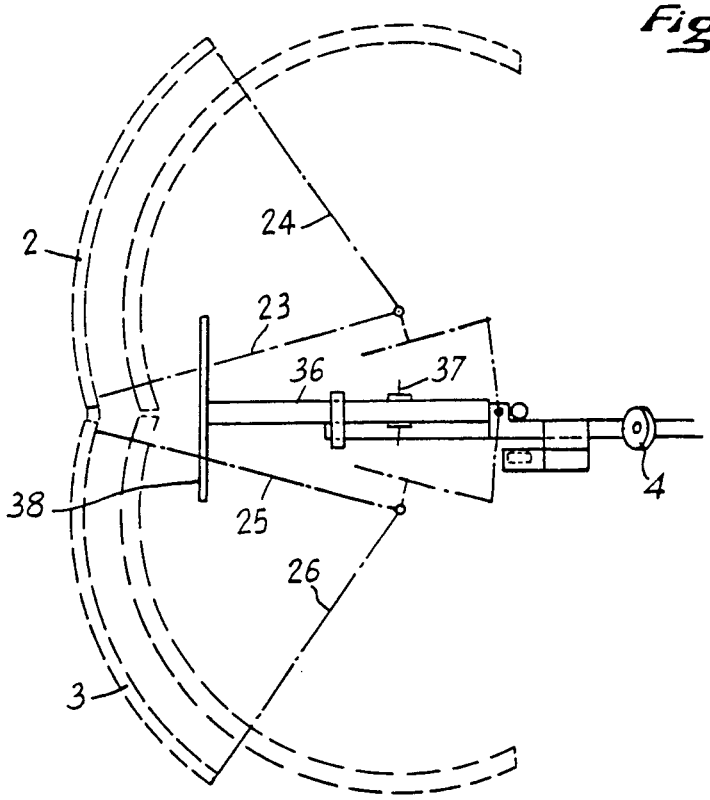
FIG. 7 is a schematical horizontal section.

In the variant shown schematically in FIGS. 5 to 7, control of the door leaves is only provided at their upper end under the action of the control piece 9 without the use of a control piece in the lower part. It will be noted that a control of the door leaves could also be used at the bottom without a control at the top.

In the case of controlling the door leaves by only one of the heightwise ends, at the other end, in the place of the opening and closing control, a device may be provided for locking in the closed position. For this, in the embodiment shown in FIGS. 5 to 7, a cam 33 fixed to the control piece 9 in the closed position lowers the vertical rod 34 urged upwardly by a lower spring 35 acting on a locking lever 36 which is pivotally mounted by one of its ends to the base of rod 34. This lever 36 pivots between its ends at 37 on a fixed horizontal shaft integral with the chassis whereas its end opposite rod 34 has the shape of a T whose cross piece ends in two hooks intended, in the lowered position of rod 34, to retain stops of the two door leaves in the locked position while leaving these leaves with a possibility of a limited gap therebetween.

Figure 8:
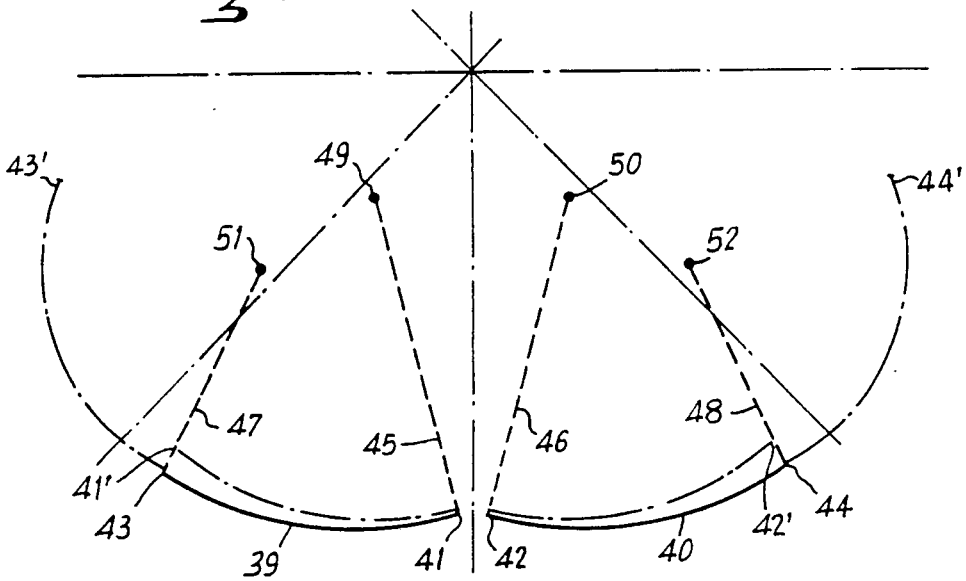
FIG. 8 shows schematically in a top view a variant in which each leaf, instead of pivoting with a movement through an arc of a circle about a single vertical axis, is secured to two arms of different lengths connected to the opposite vertical edges of the leaf and pivoting about different vertical axes.

In the two embodiments shown in FIGS. 1 to 4 and 5 to 7, each of the two leaves of a car door pivots about a vertical axis with a movement through an arc of a circle in a horizontal plane. It would however be possible, particularly in the case of doors of reduced height, to use as shown in FIG. 8 two symmetrical door leaves 39–40 whose side edges 41–42 and 43–44 pivot about different vertical axes on which are articulated rotational arms of different lengths. One example of such door leaves is shown schematically by the top view of FIG. 8 in which at 41–42 are shown the side edges of the two leaves 39–40 situated one against the other in the closed position and at 43–44 the opposite edges. The rotational arms connected to edges 41 to 44 are shown at 45 to 48 respectively and the axes of rotation from 49 to 52. The horizontal tracks of the ends of the arms have been shown with dot dash lines and at 41' to 44' the positions of the edges of the door leaves when these leaves have been brought into an open position, whereas FIG. 8 shows them schematically in the closed position.

It will be understood that the embodiments described above have no limitative character and that different variants could be envisaged without for all that departing from the scope and spirit of the invention defined by the accompanying claims.

What I claim is:

1. In a passenger transporting cable car having a door comprising two leaves symmetrical to each other with respect to a vertical plane passing through the junction line of the two leaves in the closed position, a mechanism for actuating said door which comprises:

a control piece disposed at one of the heightwise ends of the car and having a horizontal rectilinear movement parallel to the vertical plane of symmetry of the two door leaves, a crank lever integral with said control piece and adapted to actuate a horizontal dead point clearance toggle joint, said toggle joint being formed of two symmetrical links each actuating a lever, at least one arm fixed to each one of said door leaves and adapted to pivot about a fixed axis, said arm being connected to a lever of said toggle joint, and a resilient connection between said arm and said lever allowing a limited oscillation of the corresponding door leaf in a closed position with respect to the lever, and consequently allowing a gap between the two door leaves in the closed position locked by the position of the toggle joint brought beyond its dead point.

2. The mechanism for actuating a door with two symmetrical leaves as claimed in claim 1, comprising a vertical shaft driven in rotation by the rectilinear movement of the control piece provided at one of the heightwise ends of the leaves, this shaft in its turn causing, at the other heightwise end of the door leaves, a movement of a second control piece which actuates a horizontal dead point toggle joint identical to the one actuated by the first control piece.

3. The mechanism for actuating a door with two symmetrical leaves as claimed in claim 1, wherein the control piece comprises a cam acting in the closed position on one of the ends of a vertical rod which extends over the whole height of the door leaves and whose other end is pivotally mounted to a locking lever having hooks for retaining the adjacent edges of the corresponding heightwise ends of the door leaves.

4. The mechanism for actuating a door with two symmetrical leaves as claimed in claim 1, wherein the pivoting arms fixed to the door leaves bear in the vicinity of the leaves by rollers on a running track integral with the chassis of the car.

5. The mechanism for actuating a door with two leaves as claimed in claim 1, wherein the control piece with horizontal rectilinear movement parallel to the vertical plane of symmetry is actuated by a handle integral with a toothed sector meshing with a rack of the control piece.

6. A mechanism for actuating a door with two symmetrical leaves as claimed in claim 1, further including two actuating arms of different length, wherein each one of the two leaves is fixed to said two actuating arms of different lengths, said arms pivoting at one of the heightwise ends of said leaf about two different vertical axes.

* * * * *